United States Patent [19]

Giardini

[11] Patent Number: 4,462,348

[45] Date of Patent: Jul. 31, 1984

[54] ENGINE STARTING SYSTEM

[75] Inventor: Dante S. Giardini, Dearborn Heights, Mich.

[73] Assignee: Ford Motor Company, Dearborn, Mich.

[21] Appl. No.: 297,674

[22] Filed: Aug. 31, 1981

[51] Int. Cl.[3] ..... F02N 17/00

[52] U.S. Cl. ..... 123/179 R; 123/180 R

[58] Field of Search ..... 123/179 E, 180 R, 184, 123/179 R, 179 F, 179 L, 557

[56] References Cited

U.S. PATENT DOCUMENTS

| | | | |
|---|---|---|---|
| 867,797 | 10/1907 | Coleman | 123/180 R |
| 1,595,109 | 8/1926 | McElroy et al. | 123/179 E |
| 2,053,321 | 9/1936 | Brown | 123/180 R |
| 2,273,448 | 2/1942 | Patterson | 123/180 R |
| 2,348,621 | 5/1944 | Hanlon | 123/184 X |
| 3,999,525 | 12/1976 | Stumpp et al. | 123/557 |

*Primary Examiner*—Parshotam S. Lall

*Assistant Examiner*—W. R. Wolfe, Jr.

*Attorney, Agent, or Firm*—Peter D. McDermott; Roger L. May

[57] ABSTRACT

An engine starting system for a four-cylinder internal combustion engine includes an electric fuel pump connected to fuel injection valves mounted within each cylinder of the engine, an electric blower for blowing air into the cylinders to increase the air pressure above atmospheric levels within a cylinder housing a piston in the intake stroke mode, glow plugs mounted within each cylinder to ignite the fuel fed through the injection valves, and an intake valve which is normally open when a piston is in its intake stroke mode. The intake valve is constructed to close when a predetermined high pressure is within a cylinder to trap explosive pressure of the ignited fuel within the cylinder to drive the piston when it is in its intake stroke mode such that the engine is started solely by explosive power within said cylinders.

21 Claims, 6 Drawing Figures

ENGINE STARTING SYSTEM

FIELD OF THE INVENTION

This invention relates to an internal combustion engine and more particularly, to an internal combustion engine including a starting system.

DISCLOSURE INFORMATION

Starting systems have commonly been provided for internal combustion engines. One commonly known starting system includes an electric starting motor, usually referred to as the starter, which through a series of gears and an overrunning clutch turns the crankshaft which in turn commences motion of the piston such that a fuel and air mixture is drawn into the cylinder during an intake stroke and subsequently compressed and ignited. If a fuel injection system is used, air is drawn into the cylinder during the intake stroke and subsequently compressed during the compression stroke. Fuel is then sprayed into the cylinder. An igniter such as a spark plug or glow plug ignites the fuel and air mixture.

This known starting system requires the addition of a starter, extra gears, an overrunning clutch, and a battery which carries a sufficient electrical charge to turn over the starter against the friction and inertia presented by the engine. If the battery is weak, often there is not enough power for the starter to overcome the high frictional forces and inertia to commence motion of the crankshaft and piston.

Improvements in starting systems have been attempted. One such systsem is disclosed in U.S. Pat. No. 3,626,918 issued to Brenneke on Dec. 14, 1971. The Brenneke patent discloses a diesel engine which is attached to a high pressure gas accumulator and chemical pressure generator system that produces a gas of high pressure and high temperature. If the engine is warm, a distributorsystem allows the high pressure gas from the accumulator system to enter the appropriate cylinder to impart motion to the piston to turn over the engine. When the engine is cold the chemical pressure generator system is turned on to allow gas of high pressure and high temperature to commence motion of the engine while simultaneously warming it. The Brenneke patent discloses a system that requires the use of external tanks, valves, and chemicals.

It is desirous to have an internal combustion engine provided with a starting system that requires no additional motors or tanks.

SUMMARY OF THE DISCLOSURE

According to one embodiment of the invention, an engine starting system is provided to commence motion of the pistons in the engine solely by the internal combustion within the cylinders. The engine has a multiple number of pistons and cylinders and has a four-stroke cycle.

The starting system includes an electric fuel pump for pumping fuel into the engine cylinders, glow plugs used to ignite the fuel and air mixture contained within the engine cylinders, an electric blower for blowing air into the cylinders, and pressure responsive intake valves for trapping explosive pressure from ignited fuel within the cylinders when their pistons are in the intake stroke mode. The intake valves are normally open when the pistons are in their intake stroke mode. Each valve is pressure responsive to close when pressure within the cylinders is above the pressure in the intake manifold a predetermined amount. The blower when actuated increases the air pressure within the cylinders when their pistons are in the intake stroke mode to pressures above atmospheric levels.

An ignition system ignites fuel injected into the cylinders from the fuel pump. The resulting explosion increases the pressure within the cylinders above the pressure within the manifold more than the predetermined amount to close the intake valves that are in the open position. The closed valve causes the explosive pressure of ignited fuel within the cylinder to move the piston and commence motion of the engine.

Preferably, each pressure responsive intake valve includes a valve stem with an annular head slideably mounted thereon. The annular head sits within and seals an inlet port. When the piston is in an intake stroke mode, the annular head is spring biased away from the port toward an open position but is yieldable under explosive pressure within the cylinder to close the inlet port and to trap combustion gases in the cylinder.

It is desirous that the internal combustion engine has a multiple of four cylinders and pistons such that an equal number of pistons are in the power stroke mode, intake stroke mode, exhaust stroke mode, and compression stroke mode at any given time.

The broader aspects of the invention include a starting system for an internal combustion engine having a feeding system for feeding fuel into a cylinder when the piston housed therein is stationary, an ignition system for igniting the fuel contained in the cylinder when the piston is stationary, and a pressure responsive intake valve for trapping explosive pressure of the ignited fuel in the cylinder to commence motion of the piston downward.

The invention also incorporates a method of starting an internal combustion engine having a chamber and driving member moveable therein. The method includes the steps of feeding the fuel into the chamber when the driving member is stationary, igniting the fuel in the chamber when the driving member is stationary, and trapping the explosive pressure of the ignited fuel in the chamber to commence motion of the driving member solely by the explosive pressure within the cylinder.

The invention eliminates the need of starters and external tanks. Consequently, the risk of these parts to function improperly is eliminated. In addition, the weight of the engine can be significantly reduced by the elimination of heavy starters and external tanks. Furthermore, the starting system is quieter than conventional starter motors due to the elimination of noisy meshing gears commonly found in conventional starters.

BRIEF DESCRIPTION OF THE DRAWING

Reference now will be made to the accompanying drawings in which.

DETAILED DESCRIPTION OF THE PREFERRED EMBODIMENT

Figure 1:
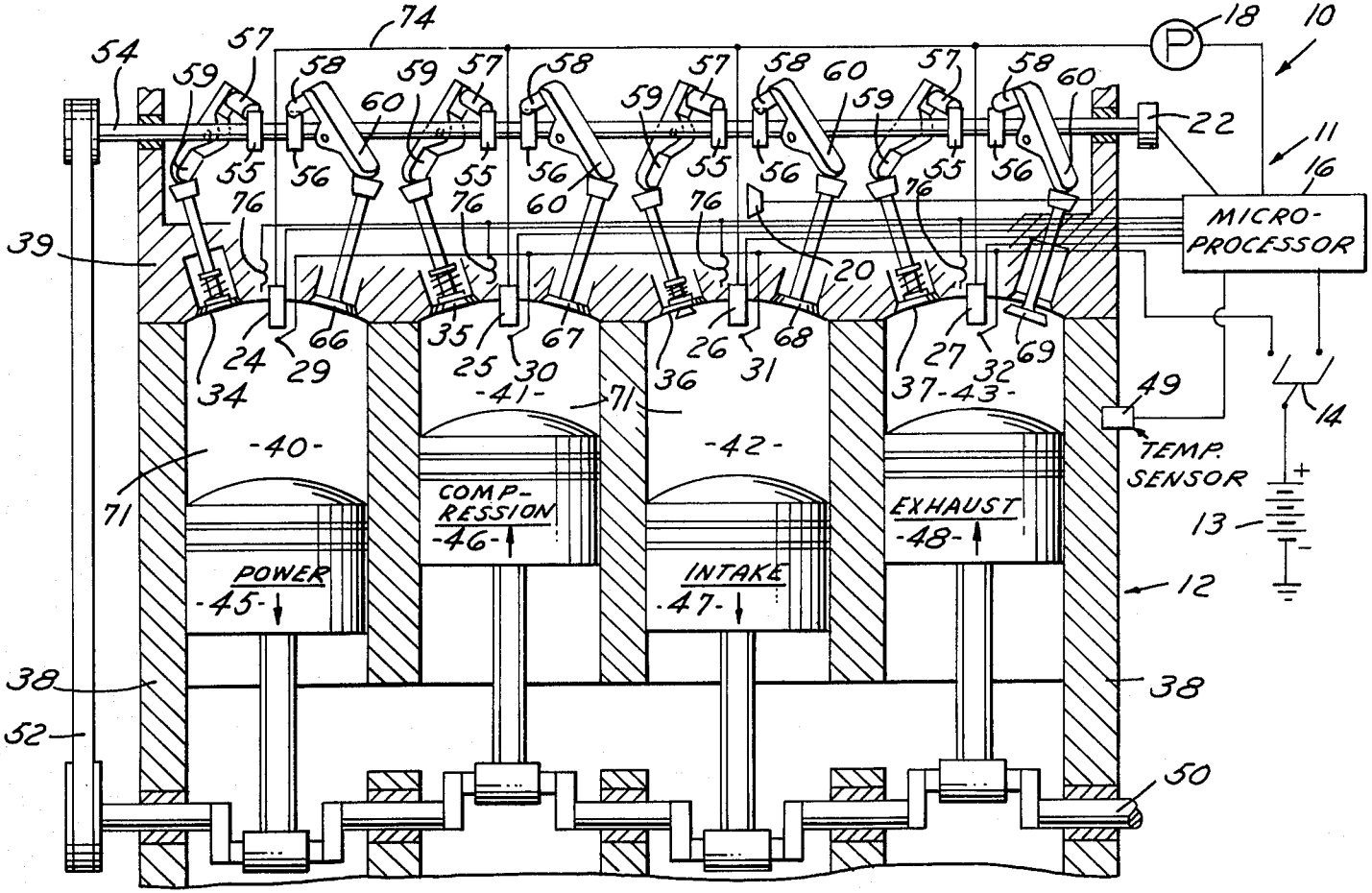
FIG. 1 is a schematic view of a four cylinder internal combustion engine incorporating one embodiment of the invention.

Referring particularly to FIG. 1, a starting system 10 is incorporated into an internal combustion engine 12. The starting system 10 incorporates an electric circuit 11 which includes as its main components a battery 13, an ignition switch 14, a microprocessor 6, an electric fuel pump 18, an electric blower 20, a shaft position sensor 22, fuel injection valves 24–27, and glow plugs 29–32. Besides the electric circuit 11, the starter system incorporates pressure responsive intake valves 34–37. The manner in which these components are interconnected to form the starting system 10 is described in detail below.

The engine 12 incorporating the starting system 10 includes an engine block 38 that has cylinders 40–43 therein. A cylinder head 39 is mounted on the block 38. The cylinders 40 through 43 house pistons 45 through 48 respectively. As shown in FIG. 1, piston 45 is in the power stroke mode, piston 46 is in the compression stroke mode, piston 47 is in the intake stroke mode, and piston 48 is in the exhaust stroke mode.

Each piston is conventionally connected to a crankshaft 50. The crankshaft 50 is connected via a timing belt 52 to a camshaft 54 rotatably mounted within cylinder head 39. The camshaft 54 has two sets of cams 55 and 56 which operate tappets 57 and 58 which in turn pivot rocker arms 59 and 60 respectively. The rocker arms 59 operate novel intake valves 34–37 described below. The rocker arms 60 operate conventional exhaust valves 66–69.

The electric circuit 11 includes the battery 13 operably connected to the ignition switch 14 that in turn is operably connected to the microprocessor 16 to provide an input signal thereto. The ignition switch 14 also connects the battery to the glow plugs 29–32 in a conventional fashion. The position sensor 22 is also operably connected to the microprocessor 16 to provide an input signal correlating to the position of the camshaft which in effect denotes the positions and the stroke mode of the pistons 45–48. A temperature sensor 49 is mounted to the engine 12 and is connected to the microprocessor to provide an input correlating to the temperature of the engine.

The microprocessor 16 in turn is operably connected to control the fuel pump 18, the blower 20, the fuel injection valves 24–27 and the heater coils 76 which are mounted in proximity to the injection valves 24–27.

The fuel injection valves can be the type shown in U.S. Pat. No. 4,197,996 issued to Giardini on Apr. 15, 1980. The position sensor can be the type disclosed in the U.S. Pat. No. 4,235,101 issued to Stadelmann on Nov. 25, 1980. Other known fuel injection valves and position sensors are acceptable.

Figure 2:
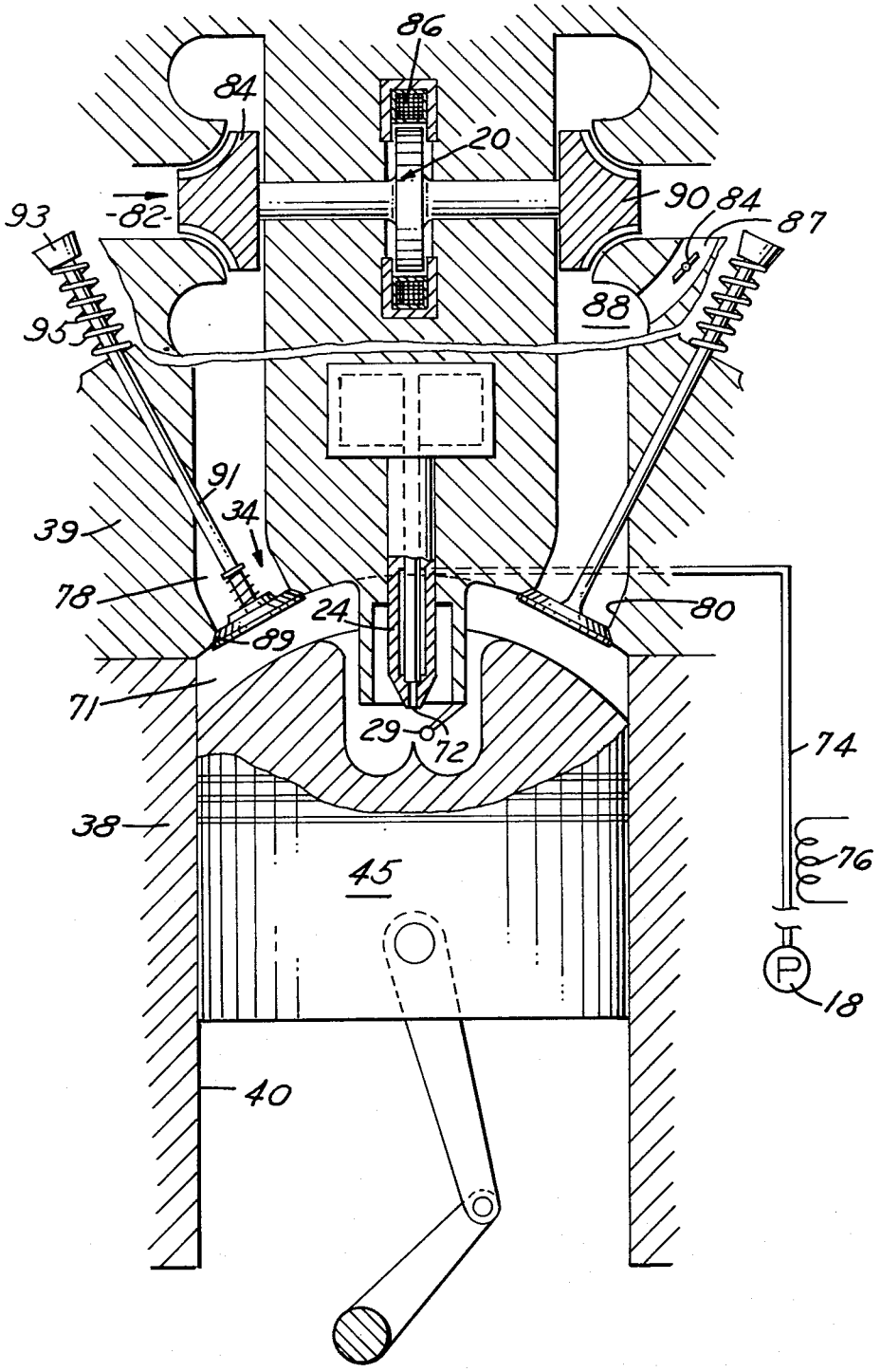
FIG. 2 is an enlarged schematic view of one cylinder of the internal combustion engine shown in FIG. 1.

Reference is now made to FIG. 2 which shows an enlarged schematic view of the cylinder 40 and piston 45 assembly. The other three cylinder and piston assemblies shown in FIG. 1 are similar in structure and, therefore, are not individually described.

The cylinder 40, piston 45 and the cylinder head 39 form a combustion chamber 71. The electromagnetic fuel injection valve 24 is secured to the cylinder head 39 and has a nozzle 72 intruding into the combustion chamber 71.The glow plug 29 is positioned below the nozzle 72. The fuel injection valve 24 communicates with a conduit 74 which is in fluid communication with the fuel pump 18. An electric heater coil 76 lies adjacent the conduit 74 in proximity to the injection valve 24.

The cylinder 40 has an inlet port 78 and an exhaust port 80. The inlet port 78 is in communication with the intake manifold 82 which operably houses the blades 84 of the blower 20. Blower 20 includes an electromagnetic assembly 86 that drives the blades 84. The blower has sufficient power to create pressures within the cylinder that are twice the normal atmospheric pressure. The exhaust port 80 is in communication with an exhaust manifold 88 which houses turbine blades 90 that are operably connected to the blower. The exhaust manifold 88 has a conventional bypass 87 and bypass control valve 84 in parallel with the section of the manifold 88 housing the turbine blades 90.

The inlet port 78 forms a seat 89 for pressure responsive intake valve 34. The intake valve 34 has a stem 91 slideably mounted in cylinder head 39. The top end 93 of stem 91 is constructed to abut rocker arm 59 shown in FIG. 1. A return spring 95 is coaxially mounted about stem 91 to move valve 34 upwardly.

Figure 3:
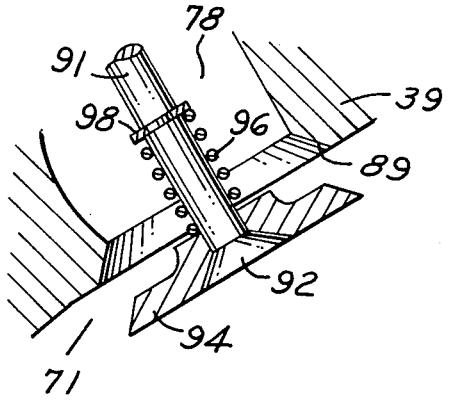
FIG. 3 is a fragmentary, partially segmented, side-elevational view of the intake valve shown in FIG. 1 with the valve in its normally open position during the piston intake stroke mode.
Figure 4:
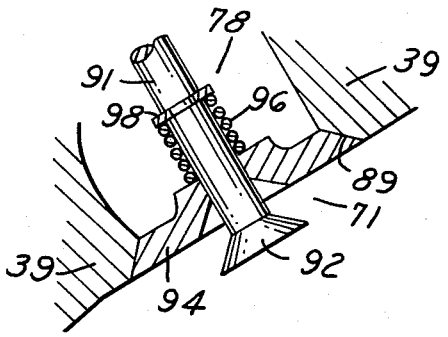
FIG. 4 is a view similar to FIG. 3 showing the intake valve in a closed position during the piston intake stroke mode.

As shown more clearly in FIGS. 3 and 4, the stem 91 has a flanged end 92. An annular valve head 94 is coaxially mounted about the stem 91. A spring 96 abuts a collar 98 fixed on the stem 91 and biases the annular valve head 94 toward an open position as shown in FIG. 3 when the piston is in the intake stroke mode.

The valve head 94 is constructed to be pressure responsive such that when the pressure in the combustion chamber 71 is above the pressure in the manifold 82 a predetermined amount, the valve head 94 slides up stem 91 against the resilient opening force of spring 96 and becomes seated on seat 89 to close the inlet port 78 as shown in FIG. 4.

OPERATION

In operation, the starter system uses the explosive forces contained in the combustion chamber for commencing motion of the pistons. The motion of the pistons is not commenced by the use of starter motors or pressurized gases from external sources. The operation of the starter system is initiated by actuation of ignition switch 14 which actuates the glow plugs 29–32 and the microprocessor 16. The microprocessor 16 in turn actuates the blower 20 and the fuel pump 18. The blower 20 passes air into the cylinder 42 past the intake valve 36 which is in an open position as illustrated in FIG. 3, to create an air pressure equal to twice atmospheric pressure within combustion chamber 71 and manifold 82. In addition, the microprocessor 16 responds to a signal from the position sensor 22 to produce an output signal to commence opening of selected ones of the fuel injection valves 34–37. As shown in FIG. 1, fuel injection valves 24 and 26 are opened and fuel is injected into the cylinders 40 and 42 housing the pistons 45 and 47 which are in the power and intake stroke modes respectively.

The fuel injected into cylinder 40 is mixed with the air contained therein. The fuel injected into cylinder 42 is mixed with air above atmospheric pressure. To assist in vaporizing the fuel during cold starts, the microprocessor 16 responds to an input signal from the temperature sensor 49. In the event sensor 49 indicates a temperature below a predetermined minimum, an output signal commands actuation of the heater coils 76. The coils 76 warm the fuel entering the injection valves and the cylinders.

The glow plugs 29 and 31 ignite the injected fuel. Upon ignition, the explosion in cylinder 40 forces the piston 45 downward. The explosion in cylinder 42 greatly increases the pressure therein relative to the pressure within the intake manifold 81. The intake valve head 94 responds to this pressure difference by moving to the position illustrated in FIGS. 1 and 4 to prevent the escape of the explosive gases, whereby the piston 47 is forced downward.

If the engine has been off for a period longer than a few minutes, any pressurized gases within cylinder 40 from the previous operation of the engine would have leaked out. Consequently, since the combustion chamber 71 of cylinder 42 is pressurized, the explosive starting force within cylinder 42 normally is greater than the explosive starting force within cylinder 40. The larger explosive force forcing piston 47 downward, in conjunction with the smaller explosive force forcing piston 45 downward, commences motion of the pistons and crankshaft. The explosive forces quickly turn over the engine at a rate of over 1,000 revolutions per minute. The microprocessor 16 responds to a signal from the sensor 22 that detects the engine speed at over 1,000 rpm to send out an output signal commanding deactuation of the electric fuel pump 18, and blower 20 and directs the engine to return to normal operating mode.

A SECOND EMBODIMENT

Figure 5:
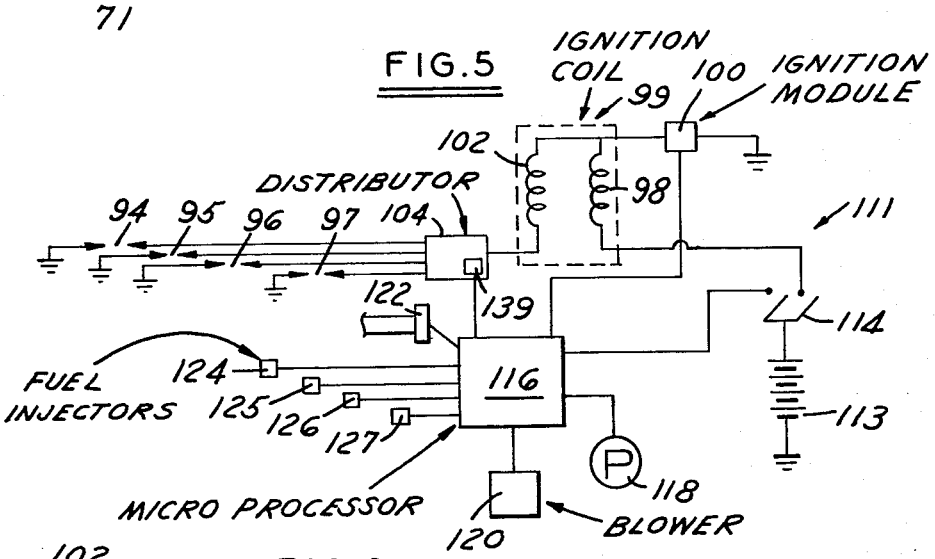
FIG. 5 is a schematic view of the electric circuit of a second embodiment of the invention.

FIG. 5 illustrates the electric circuit 111 for a second embodiment of the invention. The electric circuit 111 has the battery 113 operably connected to the ignition switch 114 that in turn is operably connected to the microprocessor 16.

The ignition switch 114 also connects the battery to the primary winding 98 of ignition coil 99 and an ignition module 100. The high voltage secondary winding 102 of coil 99 is operably connected to a distributor 104 that is connected to four spark plugs 94–97. Each spark plug 94–97 is connected in a conventional fashion to an engine cylinder head and protrudes into an engine cylinder described in the first embodiment. The microprocessor 116 is also operably connected to a position sensor 122, a fuel pump 118, a blower 120 and to fuel injectors 124–127 in the same fashion as the first embodiment.

Figure 6:
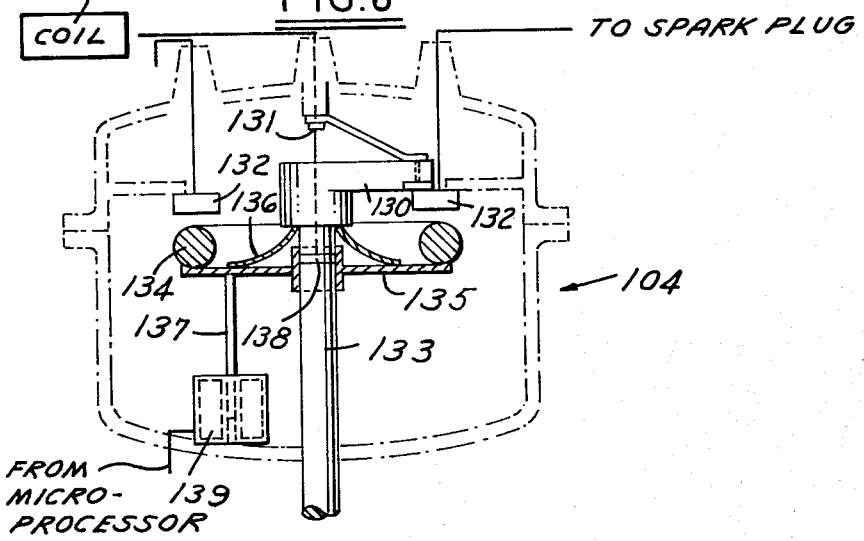
FIG. 6 is a side elevational, partially sectional, view of the distributor shown in FIG. 5.

In addition, the microprocessor 116 is connected to the distributor 104. The distributor 104 is shown in further detail in FIG. 6. The distributor 104 has a conventional armature 130 operably connected to a positive terminal 131 connected to the winding 102. The armature 130 rotates on shaft 133 to contact the terminal contacts 132 that are connected to the respective spark plugs 94–97. In addition, an electrically conductive ring 134 is mounted about shaft 133 and is in electrical contact with positive terminal 131 via a metallic ring 138 secured to the shaft 133. Leaf spring 136 retains the ring 134 spaced below the contacts 132.

The ring 134 has a spoke 135 which abuts an armature 137 of solenoid 139 which is operably connected to microprocessor 116. The armature 137 is slideably operable to move the ring 134 into and out of contact with the terminal contacts 132. The actuation of solenoid 139 forces armature 137 upward to slide the ring 134 against the downward biasing force of the spring 136 and gravity into contact with the terminal contacts 132.

In operation, actuation of the ignition switch 114 actuates the microprocessor 116 and connects the winding 98 to the battery 113. The microprocessor in turn sends out a signal commanding actuation of the ignition module 100, the fuel pump 118, blower 120, and solenoid 139 of distributor 104. The blower 120 and fuel injector valves 124–127 function in the same manner as described in the first embodiment.

Because the distributor 104 has ring 134 in contact with all contacts 132, all the spark plugs 94–97 spark simultaneously. Ignition takes place in the cylinders housing pistons in the intake and power stroke modes as described for the first embodiment. After commencement of motion of the pistons, the sensor 22 gives an input signal to the microprocessor 116 to indicate the speed of the engine is over 1,000 rpm. The microprocessor is programmed to send out a signal commanding the engine to return to normal operating mode.

A THIRD EMBODIMENT

In another embodiment, the fuel is injected to all four cylinders and all four cylinders are ignited simultaneously. The simultaneous ignition in all four chambers results in the explosive pressures exiting the exhause port in cylinder 43 while the pistons 45 and 47 are forced downwardly by the explosive pressures in cylinder 40 and 42. The explosive pressures in cylinder 41 act against the upward movement of piston 46. However, two pistons 45 and 47 drive downward against the force exerted on the piston 46. A net effect results in turning over the engine in the direction of motion of piston 45 and 47 to commence its operation.

The advantages of using the above described starting systems are multiple. A reduction in weight is possible by the elimination of starter gears and the use of a smaller battery. A smaller battery is feasible because the large amount of electric power needed to turn over an electric starter motor operably connected to the engine crankshaft is no longer required. In accordance with reducing weight, the starting system adds no significant weight to the engine. Most of the components found in the starting system are normally present in a modern conventional engine. Fuel pumps, microprocessors, blowers, and injection and intake valves are all found in many modern day engines. Applicant's invention modifies these components to render possible the above-described starting system. The starting system can reduce cost and maintain reliability by eliminating many conventional parts. In addition, due to the elimination of the starter with the toothed gears, a quiet starting system is possible. The quietness of the starting system makes it ideal for an engine which has a start-stop cycle that eliminates the idle mode to save fuel.

Variations and modifications of the present invention are possible without departing from its spirit nd scope as defined in the appended claims.

The embodiments in which an exclusive property or privilege is claimed as defined as follows:

1. A method of starting an internal combustion engine having a chamber and driving member moveable therein comprising the steps of:

feeding fuel into said chamber when said driving member is stationary to create a fuel and air mixture;

igniting said fuel and air mixture contained in said chamber when said driving member is stationary; and trapping the explosive pressure of said ignited fuel and air mixture in said chamber to power said driving member thereby commencing motion of the engine solely by said explosive pressure; wherein:

said internal combustion engine is a four-stroke reciprocating engine with a multiple number of chambers that comprise cylinders;

said driving member comprises a piston housed in each cylinder;

each piston has an intake, compression, power or exhaust stroke mode; and said trapping of the explosive pressure occurs when said pistons are in said power and intake stroke modes.

2. A method as defined in claim 1 further comprising the step of blowing air into said cylinders housing pistons in said intake stroke mode to increase the air pressure within said cylinder to above atmospheric level before said igniting.

3. An engine starting system for an engine having a combustion chamber defined in part by a piston and an intake valve means arranged in an intake stroke mode;

feed means constructed to feed fuel into said combustion chamber when said piston is stationary and said intake valve means is open;

ignition means constructed to ignite said fuel in said combustion chamber when said piston is stationary and said intake valve means is open;

said intake valve means being constructed to move to a closed position when said fuel is ignited whereby the gas pressure within said combustion chamber is increased and said piston is urged in the direction of a power stroke by said gas pressure.

4. An engine starting system as defined in claim 3 further comprising means for increasing the air pressure within said cylinder housing the piston in said intake stroke mode to above atmospheric level before said ignition means ignites said fuel.

5. An engine starting system according to claim 4 and including:

said intake valve means being pressure responsive and constructed to move to a closed position in response to an increase in gas pressure within said combustion chamber.

6. an engine starting system for a multi-cylinder internal combustion engine having cylinders and pistons that are in intake and power stroke modes;

said starting system being characterized by:

feed means for feeding fuel only to said cylinders having piston in intake and power stroke modes to create a fuel and air mixture therein;

ignition means to ignite said fuel and air contained within said cylinders;

enclosing means to trap explosive pressure of said ignited fuel and air in said cylinders to move said pistons when said pistons are in said power stroke mode and said intake stroke mode.

7. An engine starting system as defined in claim 6 further comprising a blower for blowing air into said cylinders that have their respective pistons in the intake stroke mode for mixing with said fuel and increasing the air pressure within said cylinders to above atmospheric level before said ignition means is actuated.

8. An engine starting system as defined in claim 6 further comprising means for increasing the air pressure within said cylinder housing the piston in said intake stroke mode to above atmospheric level before said ignition means ignites said fuel.

9. An engine starting system as defined in claim 8 wherein said enclosed means includes a pressure responsive intake valve for each of said cylinders; each of said intake valves being normally open when each of said pistons is in said intake stroke mode and closed when a predetermined pressure higher than said air pressure created by said increasing means is reached in the cylinder housing the piston in said intake stroke mode.

10. An engine starting system as defined in claim 6 wherein said enclosing means includes a pressure responsive intake valve for each of said cylinders which is normally open when said piston is in said intake stroke mode and closed when a predetermined pressure is reached in the respective cylinder.

11. An engine starting system as defined in claim 10 wherein said pressure responsive intake valve includes:

a valve stem;

an annular head coaxially mounted about said valve stem;

said annular head engageable with a valve seat located about an inlet port of the respective cylinder;

a biasing means biasing said annular head toward an open position but responsively yieldable under explosive pressure to allow said annular head to close said inlet port and prevent escape of combustion gases from said cylinder housing said piston in intake stroke mode.

12. An engine starting system for a multi-cylinder four-stroke internal combustion engine having cylinders and pistons that are in intake and power stroke modes;

said starting system being characterized by:

feed means for feeding fuel into both of said cylinders simultaneously to create fuel and air mixture therein;

ignition means to ignite said fuel and air mixture contained within said cylinders; and enclosing means to trap the explosive pressure of said ignited fuel in said cylinders to move both of said pistons.

13. An engine starting system as defined in claim 12 wherein said multi-cylinder engine has a multiple of four cylinders and pistons such that an equal number of pistons are in the power stroke mode, intake stroke mode, exhaust stroke mode and compression stroke mode.

14. An engine starting system as defined in claim 12 further comprising means for increasing the air pressure within said cylinder housing the piston in said intake stroke mode to above atmospheric level before said ignition means ignites said fuel.

15. An engine starting system as defined in claim 14 wherein said enclosing means includes a pressure responsive intake valve for each of said cylinders; each of said intake valves being normally open when each of said pistons is in said intake stroke mode and closed when a predetermined pressure higher than said air pressure created by said increasing means is reached in each of said cylinders housing a piston in said intake stroke mode.

16. An engine starting system as defined in claim 12 wherein said enclosing means includes a pressure responsive intake valve for each of said cylinders; each of said intake valves being normally open when each of said pistons is in said intake stroke mode and closed when a predetermined pressure is reached in each of said cylinders housing a piston in said intake stroke mode.

17. An engine starting system as defined in claim 4 wherein said multi-cylinder engine has a multiple of four cylinders and pistons such that an equal number of pistons are in the power stroke mode, intake stroke mode, exhaust stroke mode and compression stroke mode.

18. An engine starting system as defined in claim 16 wherein each of said pressure responsive intake valves includes:

a valve stem;

an annular head coaxially mounted above said valve stem;

said annular head being engageable with a valve seat located about an inlet port of one of said cylinders;

a biasing means biasing said annular head toward an open position but responsively yieldable under explosive pressure to allow said annular head to close said inlet port and prevent escape of combustion gases from said cylinder housing said piston in said intake stroke mode.

19. An engine starting system as defined in claim 18 further comprising a blower for blowing air into said cylinders housing said pistons in the intake stroke mode for mixing with said fuel and increasing the air pressure within said cylinders to above atmospheric levels before said ignition means is actuated.

20. An engine starting system as defined in claim 18 wherein said multi-cylinder engine has a multiple of four cylinders and pistons such that an equal number of pistons are in the power stroke mode, intake stroke mode, exhaust stroke mode and compression stroke mode.

21. An engine starting system as defined in claim 20 wherein said feed means feeds fuel into all cylinders such that upon exploding said fuel and air mixture within said cylinders, a net power effect results to commence motion of said engine.

* * * * *